United States Patent [19]

Hays

[11] Patent Number: 5,073,766

[45] Date of Patent: Dec. 17, 1991

[54] TRANSFORMER CORE AND METHOD FOR STACKING THE CORE

[75] Inventor: Eric L. Hays, Oshkosh, Wis.

[73] Assignee: Square D Company, Palatine, Ill.

[21] Appl. No.: 614,812

[22] Filed: Nov. 16, 1990

[51] Int. Cl.[5] ..... H01F 27/26

[52] U.S. Cl. ..... 336/217; 29/606

[58] Field of Search ..... 336/216, 217, 234, 212; 29/606, 609

[56] References Cited

U.S. PATENT DOCUMENTS

| | | | |
|---|---|---|---|
| 1,145,551 | 7/1915 | Burke | 336/217 |
| 2,811,203 | 10/1957 | Gabarino | 336/217 |
| 3,181,402 | 5/1965 | Kuck et al. | 336/217 |
| 4,480,377 | 11/1984 | House et al. | 29/583 |
| 4,594,295 | 6/1986 | Waasner et al. | 428/581 |
| 4,827,237 | 5/1989 | Blackburn | 336/212 |

*Primary Examiner*—Thomas J. Kozma
*Attorney, Agent, or Firm*—Larry I. Golden

[57] ABSTRACT

A transformer core and method of assembling the core which utilizes a plurality of two types of generally E-shaped laminations, type A and type B, each having two legs extending approximately the same distance and an outer third leg extending a distance substantially greater than the distance extended by the other two legs, thereby providing an extending outer leg portion on both laminations. The laminations are formed by stacking a number of core members, two of which are cut from a rectangular section of electrical steel. The type A core members and laminations are provided with a notch and an indentation extending from the bottom perimeter of the base. The type A and type B laminations are alternately positioned on stacking shims with the extending leg portion of all type A laminations at one side and the extending leg portion of all type B laminations on the opposite side. The notch and indentations cooperate with the shims to provide channels between the extending middle legs of the type B laminations because the dimensions of the base and middle leg of type A and type B laminations are otherwise the same. A separate transformer coil is placed over each of the three core legs. A plurality of I-shaped laminations are then positioned between the extending outer leg portions of the E-shaped laminations, are supported on the middle legs and extend to the opposite extending outer leg portions. I-shaped laminations which are positioned within the channels are inserted first thereby providing additional guidance for positioning the rest of the I-shaped laminations between those that are received in the channels.

5 Claims, 3 Drawing Sheets

FIG. 4
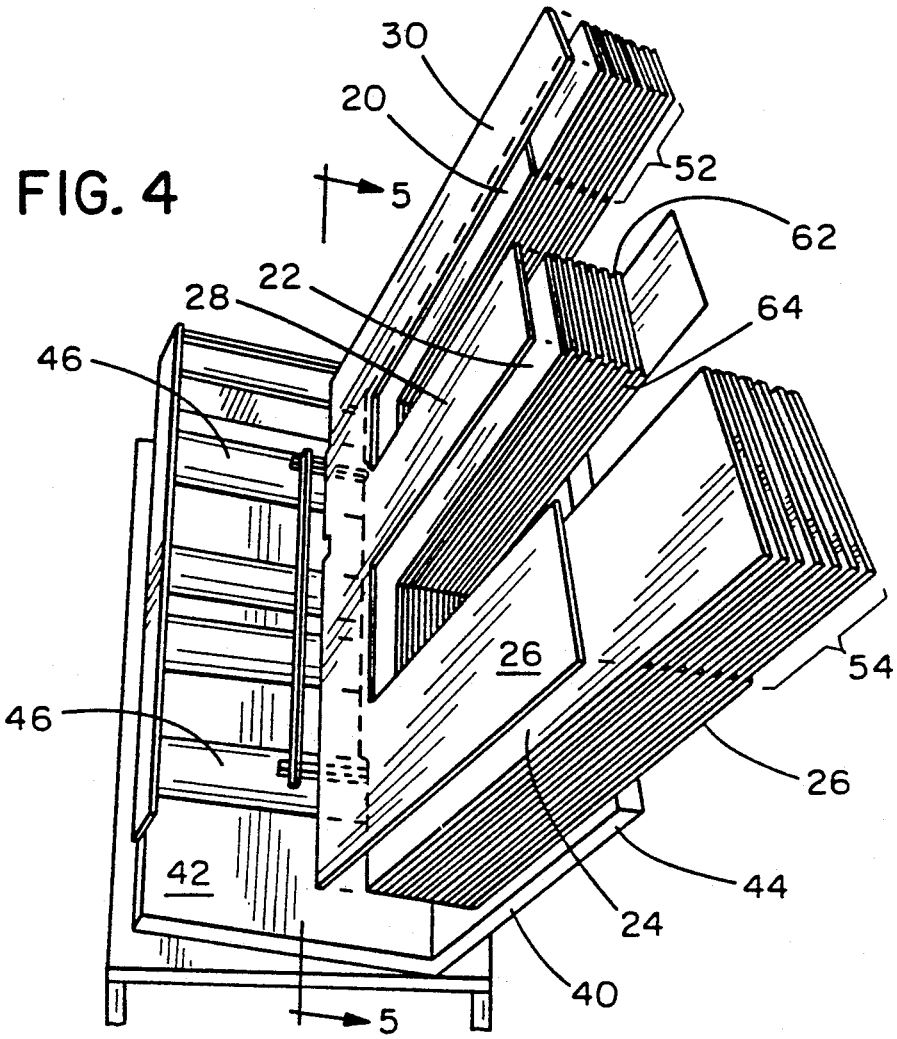
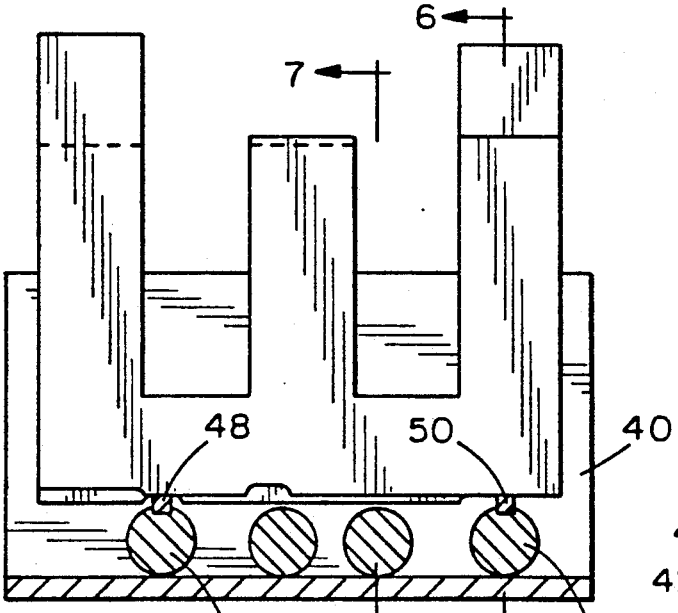
FIG. 5
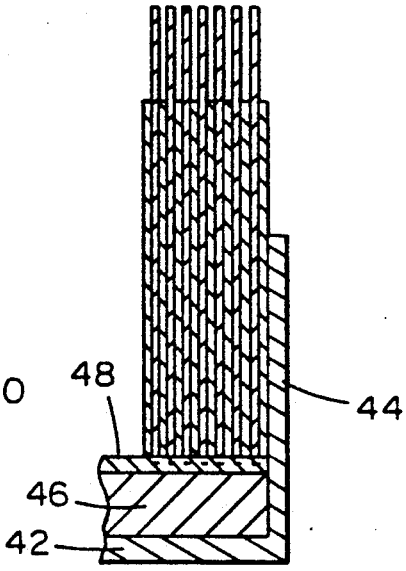
FIG. 6

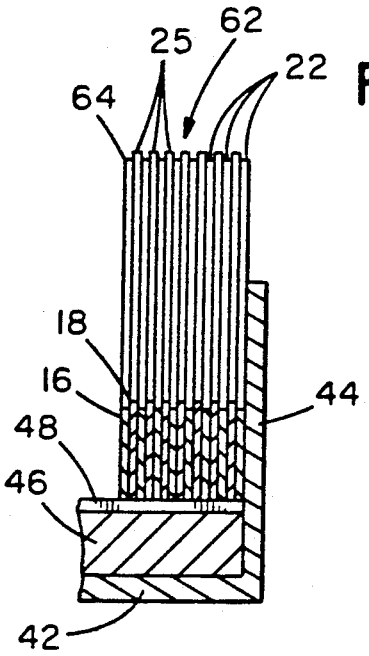
FIG. 7
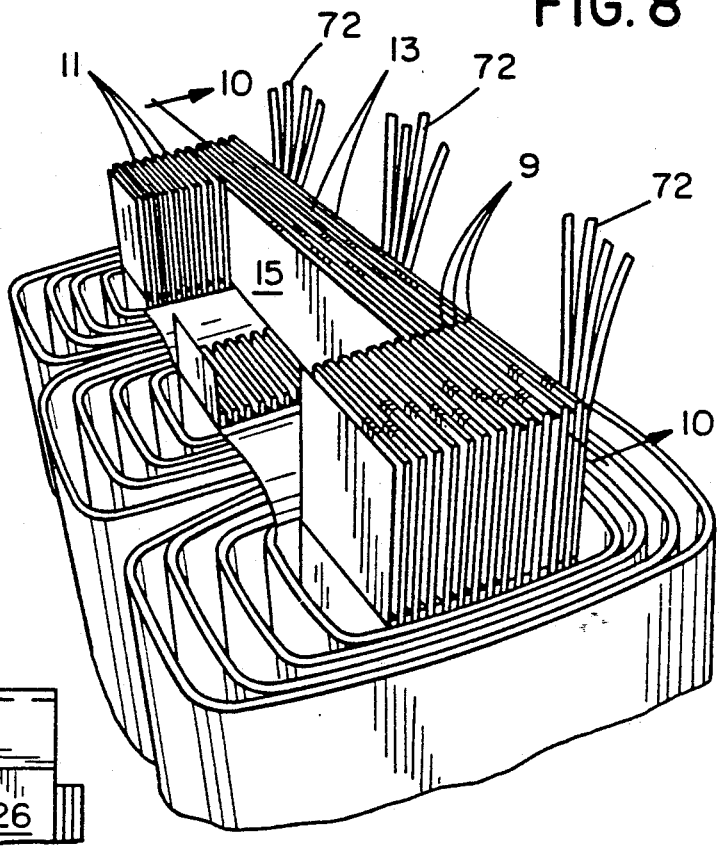
FIG. 8
FIG. 10
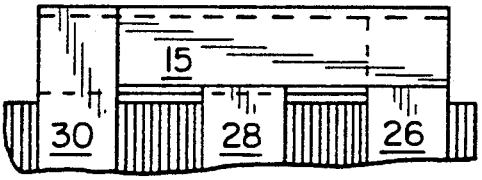
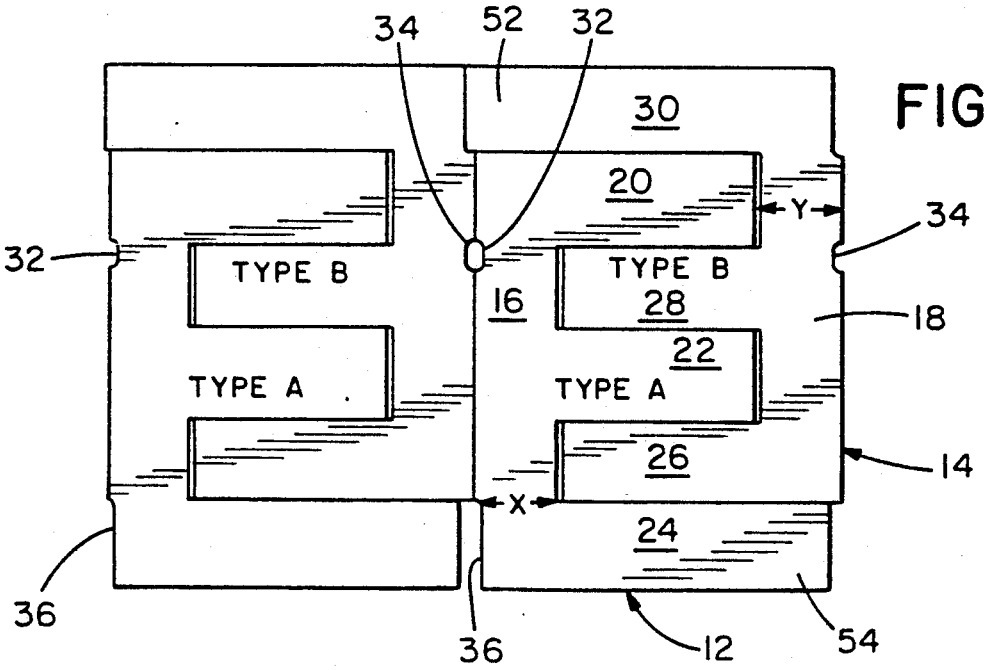
FIG. 9

TRANSFORMER CORE AND METHOD FOR STACKING THE CORE

BACKGROUND OF THE INVENTION

1. Field of the Invention

The present invention relates to an improved transformer core and a method for assembling transformer cores that utilize a plurality of multi-leg laminations having at least one leg longer than the other legs and a plurality of generally I-shaped, rectangular laminations.

2. Description of the Prior Art

Various designs and methods have been utilized to form transformer core assemblies. Some of these designs and methods are shown in U.S. Pat. No. 4,827,237 to Blackburn, in U.S. Pat. No. 4,594,295 to Waasner, et al. and in U.S. Pat. No. 4,480,377 to House, et al. It has been known to utilize a plurality of multi-leg laminations along with a plurality of generally I-shaped laminations for a transformer core. It is desirable, however, to improve the ease of assembly while maintaining or improving upon the structural integrity and performance of the transformer core.

SUMMARY OF THE INVENTION

According to this invention, there is provided a transformer core and a method for assembling the transformer core utilizing a plurality of multi-leg laminations and a plurality of generally I-shaped laminations. Two types of generally E-shaped laminations are utilized in the construction of the core assembly, type "A" laminations which are formed from one or more type "A" generally E-shaped steel core members and type "B" laminations which are formed from one or more type "B" generally E-shaped steel core members. The width of each lamination is determined by the width and number of steel core members comprising the lamination. Both type A and type B laminations have two legs extending approximately the same distance and an outer third leg extending a distance substantially greater than the distance extended by the other two legs, providing an extending outer leg portion on both laminations. Additionally, the base of type A laminations includes notched segments and indentations from the outer periphery of the base which cooperate with shims during the assembly process.

The transformer core is assembled by alternately positioning type B and type A laminations such that the extending outer leg portions for all type A laminations are on one side and the extending outer leg portions for all type B laminations are on the opposite side. These laminations are stacked on a pair of stacking shims which are received in the notches and indentations of the type A laminations and provide for alternate variations in the height of the middle leg of each type A lamination as compared with the middle leg of each type B lamination. That variation in height of the middle legs is equal to the depth of the notches or indentations, since the dimensions of the type A and type B laminations are otherwise substantially equal.

Critical dimensions are established for both type A and type B laminations to provide uniformity of design and enhance performance of the transformer. Once the type A and type B laminations have been properly positioned during assembly of the core, coils are slipped over the respective legs of the core and the I-shaped laminations are readily positioned as part of the core assembly. Uniformity of design reduces sharp edges and other variations which can cut through the coil insulation and impact performance of the transformer.

The alternate positioning of type A and type B laminations provides spacing for the plurality of generally I-shaped laminations having the same width as the type A and B laminations. Spaces are provided between outer leg portions of adjacent type A or type B laminations on each side. Channels are also provided between the extending middle legs of the type B laminations. The channels are provided as a result of the recessed association of the type A laminations caused by the notches. This facilitates both ready and stable insertion of the I-shaped laminations, each of which is received between the extending outer leg portions of the E-shaped laminations, is supported on the middle legs and extends to the opposite extending outer leg portions. The fact that the I-shaped laminations are positioned at the top of the transformer core after the coils have been positioned, without requiring any "fishing" of the laminations through the coils, facilitates secure and ready assembly of the transformer core. Alternate I-shaped laminations are received within the channels formed by the middle legs. This also facilitates insertion of the other I-shaped laminations that are readily received in the spaces between the laminations that are received within the channels.

SUMMARY OF THE DRAWINGS

FIG. 4 is a perspective view showing the invention during assembly;

FIG. 5 is a front view of the invention during assembly taken along lines 5—5 in FIG. 4;

FIG. 6 is a sectional view of the outer legs of the invention taken along lines 6—6 in FIG. 5;

FIG. 7 is a sectional view of the middle legs of the invention taken along lines 7—7 in FIG. 5;

FIG. 8 is a partial top perspective view of the invention during assembly;

FIG. 9 is a plan view showing the formation of type A and type B laminations of the invention; and FIG. 10 is a partial sectional view taken along lines 10—10.

DESCRIPTION OF THE PREFERRED EMBODIMENT

Figure 1:
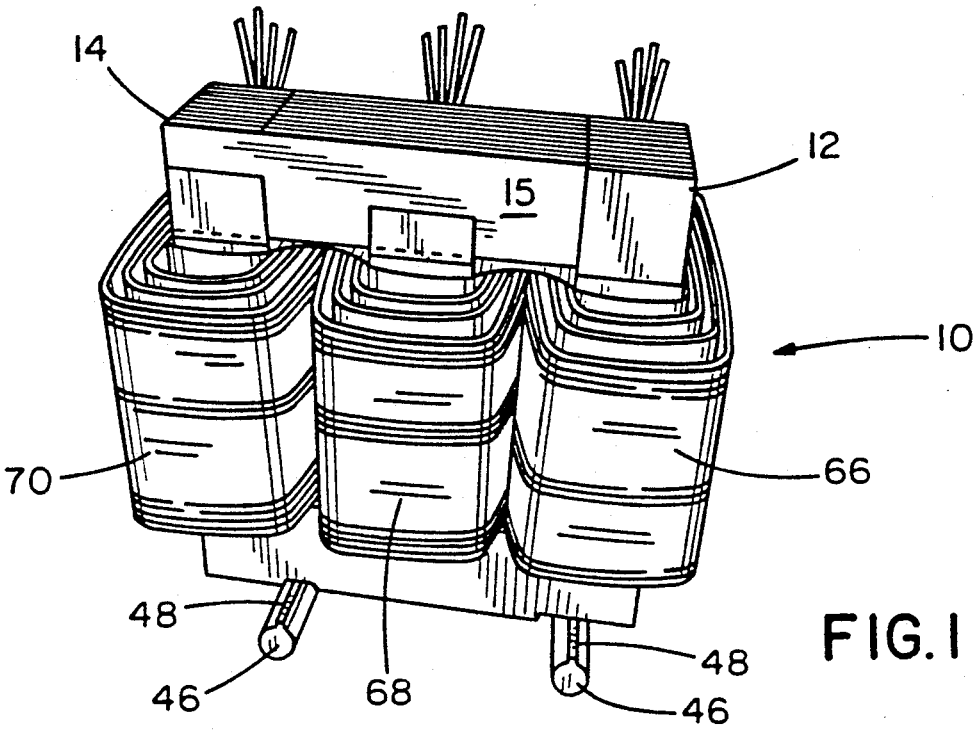
FIG. 1 is a perspective view showing the transformer core including the coils and shims.

Referring to FIGS. 1-3 and 8, a transformer core is shown which has been assembled from a plurality of generally E-shaped laminations 9,11 comprised of steel core members 12, designated as type A, and steel core members 14, designated as type B, as well as from a plurality of generally I-shaped laminations 15 comprised of generally I-shaped, rectangular steel core members. Each type A lamination 9 is comprised of one or more type A generally E-shaped steel core members and each type B lamination 11 is comprised of one or more type B generally E-shaped steel core members. As further discussed later, both type A and type B laminations have two legs extending approximately the same distance and an outer third leg extending a distance substantially greater than the distance extended by the other two legs, providing an extending outer leg portion on both laminations. It has been found that laminations comprised of five core members work well, although it can be readily seen that various other numbers would suffice, depending upon the desired performance characteristics of the transformer core and the type of steel utilized. Accordingly, a stack of five coincident core members comprise a lamination for this embodiment of the invention.

The E-shaped core members are punched and cut from a continuous flat roll of electrical steel. It has been found that AISI M19 steel is particularly suited for assembly of these cores. The roll of steel and therefore each core member has a thickness of 0.014 inches which provides a lamination thickness of 0.07 inches. As can be seen in FIG. 9, a type A and type B core member can be formed from a single, generally rectangular section of the steel with minimal scrap. Both the type A and type B core member include a base portion 16 and 18, respectively, and three extending legs, 20, 22, 24 and 26, 28, 30, respectively, with each having substantially similar configurations and dimensions.

As the steel is unrolled to form the E-shaped core members, two pieces are first punched from each section of the roll. The first piece is a small squared section which provides notches 32 and 34 in the respective bottom perimeter of the base portions of type A and type B laminations. The second piece punched is a finger-like section extending perpendicularly inward from one side a distance approximately equal to the width of the leg and forming an indentation 36 in the bottom perimeter of the base 16 of type A core members and laminations. The notch 32 and indentation 36 in each type A core member and resulting lamination are integral parts of the transformer core design. This method of forming the core members provides the notch 34 in the type B core members as well as the notch 32 in the type A core members. Although it is not necessary for there to be a notch in the type B core members, so long as it does not interfere with the proper assembly or performance of the core as hereinafter discussed, it is of little concern.

After these two pieces are punched from the roll of steel to form the notch 32 and indentation 36, the type B core member shown on the right in FIG. 9 is cut out in the E-shaped configuration. The roll is advanced, the next two pieces are punched out to form the notch and indentation and the next type B core member shown on the left in FIG. 9 is cut out which also results in the separate formation of a type A core member which is shown on the right.

The cutting equipment is set up to provide two critical distances, one for each of the types of core members and resulting laminations. It is more important that all type A core members and all type B core members be uniform than it is to have any particular dimensions for either type of core member. Accordingly, the critical dimension for type A core members X is the distance from the top of the notch and indentation to the top portion of the base 12 while the critical dimension for type B core members Y is the distance from the bottom edge of the base 18 to the top edge of the base 18. These dimensions must be consistent to provide uniformity of each type A and type B lamination.

Although many variations could be utilized, the transformer core is assembled on a support frame 40 which includes a bottom support 42 and a back support 44. Several roller supports 46 are carried by the bottom support 42 and stacking shims 48 are supported on two of the rollers as shown in FIGS. 4 and 5. The stacking shims are suitably secured to the two rollers as shown and extend outwardly perpendicular to the back support 44 in parallel relationship to the other roller members. The shims are dimensioned and positioned to be received within the notch 32 and indentation portion 36 of the type A core members and resulting laminations.

Figure 2:
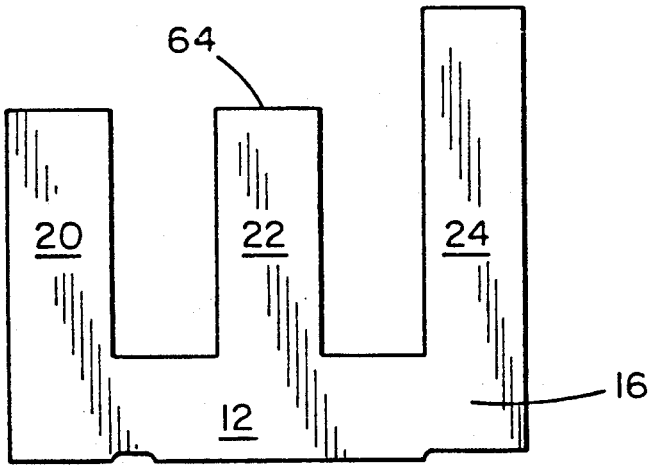
FIG. 2 is a front view of a type A core member.
Figure 3:
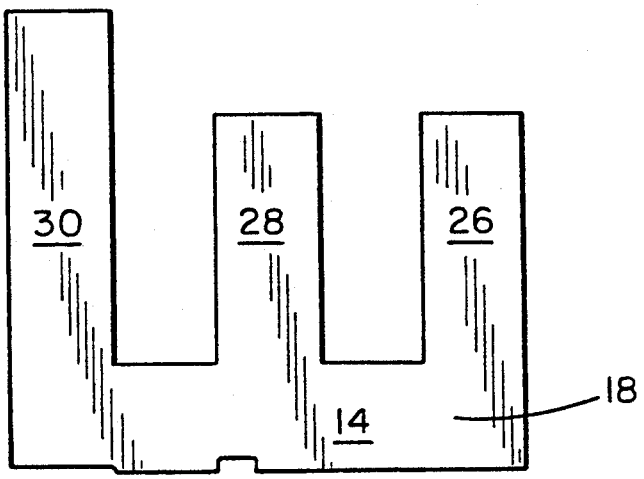
FIG. 3 is a front view of a type B core member.

Referring to FIGS. 2 and 3 where the type A and type B generally E-shaped core members are respectively shown, it can be seen that the dimensions of the base and legs are virtually identical and if the type B core member was flipped so as to position the extending leg 30 of the type B core member on the extending leg 24 of the type A core member, all legs would be coincident. During assembly, however, type A and type B generally E-shaped laminations are alternately stacked or positioned upon the support frame 40, with the extending legs of the type A laminations on one side and the extending legs of the type B laminations on the opposite side as can be seen in FIG. 8. The laminations are positioned such that the stacking shims 48 and 50 are respectively received within the notch 32 and indentation 36 of the type A laminations. As shown in FIG. 2, both the notch and indentation portions of the base of the type A core members provide indentations of approximately 0.09 inches. The notch is approximately one inch in width which is sufficient to receive the stacking shim which measures approximately onequarter inch in width. So long as the notch 34 on the type B lamination does not cooperate with either shim 48 or 50, the fact that this method of manufacture provides a notch in the type B lamination is inconsequential.

This method of alternately positioning the type A and type B laminations creates a staggered step at the top of the core legs which can perhaps best be seen by looking at the middle legs in FIGS. 4 and 7. The staggered step is substantially more pronounced at each of the outer legs as seen in FIGS. 4 and 6.

This assembly provides an extending portion 52 of the outer legs 30 of type B laminations on the one side and an extending portion 54 of the outer legs 24 of type A laminations on the opposite side. As seen from FIG. 4 of the Drawings, legs 30 of type B laminations are alternately positioned next to legs 20 of type A laminations while middle legs 28 of stacks of type B laminations are alternately positioned with middle legs 22 of type A laminations and legs 26 of type B laminations are alternately positioned with legs 24 of type A laminations.

The space between extending portions 52 is adapted to receive and end of a generally I-shaped lamination 15. It should be noted that the width of all type A laminations, type B laminations, and I-shaped laminations are substantially equal. Similarly, the space between the extending portions 54 is adapted to receive the end of a generally I-shaped lamination 15.

The staggered step arrangement provides a plurality of channels 62 formed by the adjacent middle legs of type B laminations and the top portion 64 of middle legs of type A laminations.

In this manner, the core can be assembled to its desired thickness by positioning a sufficient number of type A laminations and type B laminations on the support frame. The frame may be inclined toward the back support to facilitate stacking of the laminations. After a sufficient number of laminations are alternately positioned the bases may be clamped or otherwise secured together by conventional means. Transformer coils 66, 68 and 70 having connector wires 72 are then set over the core legs which are formed from the alternate type A and type B laminations. The assembly is then further secured by stacking or positioning the generally I-shaped laminations 15 between the alternately positioned type A laminations 9 and type B laminations 11. As can be readily seen, every other rectangular lamination 15 will be received within a channel 62 on the middle leg. Each rectangular lamination will also be received between the extending portion 52 or 54 of one of the outer legs and supported on the top of leg 20 or 26. For ease of assembly, the I-shaped laminations are first positioned within the channels 62. Those laminations then provide additional channels for positioning the remaining I-shaped laminations therebetween. After all I-shaped laminations have been inserted, the top of the core assembly can be secured by conventional means and the coil wires connected to a terminal means for the transformer.

It should be further noted that both type A and type B laminations have a predetermined base width Y which is also equal to the width of the I-shaped laminations and equal to the distance that the extending portions 52 and 54 extend beyond the other legs of the respective laminations. It will also be apparent that modifications can be made to the core members, laminations and transformer core assemblies formed therefrom without departing from the spirit and scope of this invention and it is intended that all matter contained herein including matter shown in the accompanying drawings, shall be interpreted as illustrative and not as limiting the following claims.

I claim as my invention:

1. A transformer core assembly comprising:

a first plurality of generally E-shaped laminations, each lamination of said first plurality having a base portion, a first outer leg extending a first predetermined distance outward from said base portion, a middle leg extending substantially said same first predetermined distance outward from said base portion and a second outer leg having an extending outer leg portion extending substantially beyond said first predetermined distance outward from said base portion;

a second plurality of generally E-shaped laminations, each lamination of said second plurality having a base portion, a first outer leg extending a second predetermined distance outward from said base portion, a middle leg extending substantially said same second predetermined distance outward from said base portion and a second outer leg having an extending outer leg portion extending substantially beyond said second predetermined distance outward from said base portion;

said first plurality of laminations alternately stacked with said second plurality of laminations such that said second outer legs of said first plurality of laminations are positioned at one end of the core and said second outer legs of said second plurality of laminations are at an opposite end;

said first outer legs of said second plurality of laminations alternately positioned with said second outer legs of said first plurality of laminations and said first outer legs of said first plurality of laminations alternately positioned with said second outer legs of said second plurality of laminations;

said middle legs of said first plurality of laminations alternately positioned with said middle legs of said second plurality of laminations, said middle leg of said first plurality of laminations extending beyond said middle leg of said second plurality of laminations and providing a channel portion therebetween;

a first coil surrounding said plurality of first outer legs; a second oil surrounding said plurality of middle legs; and a third coil surrounding said plurality of second outer legs;

a plurality of generally I-shaped laminations interleaved within the spaces between said plurality of extending outer leg portions of said first outer legs or interleaved within the spaces between said plurality of extending outer leg portions of said second outer legs and supported on said middle legs and extending to said other outer leg.

2. A transformer core as claimed in claim 1, wherein each generally E-shaped lamination comprises a group of five generally E-shaped steel core members and each said generally I-shaped lamination comprises a group of five generally I-shaped steel core members.

3. A transformer as claimed in claim 1, wherein said second plurality of E-shaped laminations each include a base portion having a non-linear bottom perimeter.

4. A transformer as claimed in claim 3, wherein said base portion includes a notched segment extending upward from the bottom perimeter.

5. A transformer as claimed in claim 4, wherein said second plurality of E-shaped laminations each further include an indentation portion extending upward from the bottom perimeter.

* * * * *